United States Patent [19]

Peniche

[11] 4,062,387

[45] Dec. 13, 1977

[54] DISPOSABLE FUNNEL APPARATUS

[76] Inventor: Hector Peniche, 3255 Steinway St., Long Island City, N.Y. 11103

[21] Appl. No.: 703,289

[22] Filed: July 8, 1976

[51] Int. Cl.[2] ..... B65B 39/00

[52] U.S. Cl. ..... 141/337

[58] Field of Search ..... 141/114, 199–205, 141/297–300, 331–345

[56] References Cited

U.S. PATENT DOCUMENTS 952,313 3/1910 Droz ..... 141/337

*Primary Examiner*—Houston S. Bell, Jr.
*Attorney, Agent, or Firm*—Robert D. Farkas

[57] ABSTRACT

This disclosure pertains to a disposable funnel apparatus comprising a pair of sheets being fabricated from a flexible water impervious material. The sheets are disposed in overlying relationship and are joined together along portions of the marginal edges thereof. Intermediate said portions, a pair of open mouths communicate to a common internal passageway therein-between. One of the mouths has a large opening and is utilized to collect fluids therein. The other mouth, having a smaller opening, is utilized to dispense the collected fluid. The marginal edges comprising the larger mouth are convoluted so as to enable the entire assembly to be transformed from a two dimensional flattened condition into a functional three dimensional shape, when forced inwardly into the larger mouth.

9 Claims, 7 Drawing Figures

DISPOSABLE FUNNEL APPARATUS

BACKGROUND OF THE INVENTION

1. The Field of the Invention

This invention relates to funnels and more particularly to that class designed to be disposed after a single use.

1. Description of the Prior Art

The prior art abounds with funnels of diverse constructional details. U.S. Pat. No. 2,100,888 issued on Nov. 30, 1937 to O. L. Vine teaches a scored fan-like pseudo-flexible sheet of material adapted to be joined together at the divergent marginal edges thereof. A dispensing port is formed at the ends of the divergent marginal edges closest to each other whilst a fluid collecting port is formed at the marginal edges adjacent the ends of the divergent marginal edges furthest apart from one another. A pair of tabs disposed on the marginal edges adjacent to the ends of the divergent marginal edges most widely spaced apart, form handles and stiffeners for the assembled funnel. This apparatus suffers the difficulty of requiring the assembly of the divergent marginal edges to each other prior to use, thus increasing either the use time or the pre-use volume occupied by the apparatus after assembly.

U.S. Pat. No. 3,572,318 issued on Mar. 23, 1971 to T. N. Garland discloses a flat sheet having a symetrical pattern of marginal edge shapes and score lines. The apparatus serves the particular function of being a urine specimen collection aid. It is folded up by convoluting the corners in accordion style so as to provide a large collecting mouth and an attached scoop-like structure disposed adjacent to the outermost marginal edges and a small dispensing port about an inner marginal edge, utilized to dispense collected urine into a vial or test-tube. The shape of the marginal edges enable the apparatus to be placed adjacent the body of the user so as to have the peripheral edges of the folded up shape comply with the shape of the body surrounding the urethral track.

Each of the aforementioned Patents suffers the common deficiency of requiring the user to perform not one, but a series of steps to fold up and prepare the apparatus so as to permit it to function as a funnel. Furthermore, the aforementioned apparatus requires scoring of the material comprising the apparatus, thus increasing costs of manufacture and precluding variations in the use due to the constrained shape of the apparatus.

SUMMARY OF THE INVENTION

A primary object of the present invention is to provide a disposable funnel which can be economically fabricated from two sheets of material requiring minimally one motion on the part of the user to open the device from a flattened two dimensional storage position into a three dimensional use position.

Another object of the present invention is to provide a funnel apparatus which may, if desired, be forced to retain a three dimensional shape when opened up from a flattened state.

Still another object of the present invention is to provide a funnel which is totally pre-assembled prior to use and maintained in a flattened condition there-before.

Yet another object of the present invention is to provide a disposable funnel that may be economically fabricated from two identically shaped sheets of material, thereby minimizing the cost of manufacture.

A further object of the present invention is to provide a disposable funnel whose collecting mouth portion is disposed along-side the length thereof, thereby facilitating the use of such a device in adding liquids to the gas tank or carburetor of a motor vehicle.

The uses for an inexpensive disposable liquid dispensing funnel include filling openings associated with a motor vehicle whilst protecting the poured liquid from the effects of wind or air being driven by the fan of the engine. Conventional funnels of either the permanent or disposable types almost univerally place the liquid dispensing port directly beneath the larger open mouth collecting port thereby allowing the wind to affect the liquid as it is being collected into the funnel. Often times, the mouth of the funnel, defined by the adjacent marginal edges thereto, resides in a plane skewed with the earth, causing the amounts of the collected liquid to be minimized so as to slow up the funneling process.

The present invention eliminates these objections as well as the objection, heretofore obtained, of requiring disposable funnels to be assembled into a functional three dimensional state by performing a series of complex assembly steps often times including folding and fastening.

The present invention utilizes a shoe-like structure, fabricated by two sheets of material joined together at the heel line, running continuously along the central part of the sole to an open toe area, thence thereafter rejoining the sheets on the opposite side of the open toe area to a point equivalent to the juncture of the vamp and the instep of the shoe. The mouth portion, similar to the mouth portion of the equivalent shoe shape, is utilized for collecting purposes whilst the open toe portion of the equivalent shoe shape is used for dispensing purposes. The volume intermediate the toe portion and the instep portion, defined by the "vamp" portion of the shoe and the sole portion juxtaposed therewith, serves as the liquid storage area for the funnel intermediate the collecting mouth and the dispensing mouth thereof.

These objects, as well as other objects of the present invention, will become more readily apparent after reading the following description of the accompanying drawings.

DESCRIPTION OF THE PREFERRED EMBODIMENT

Figures 1, 2, 3, 4, 5, 6, 7:
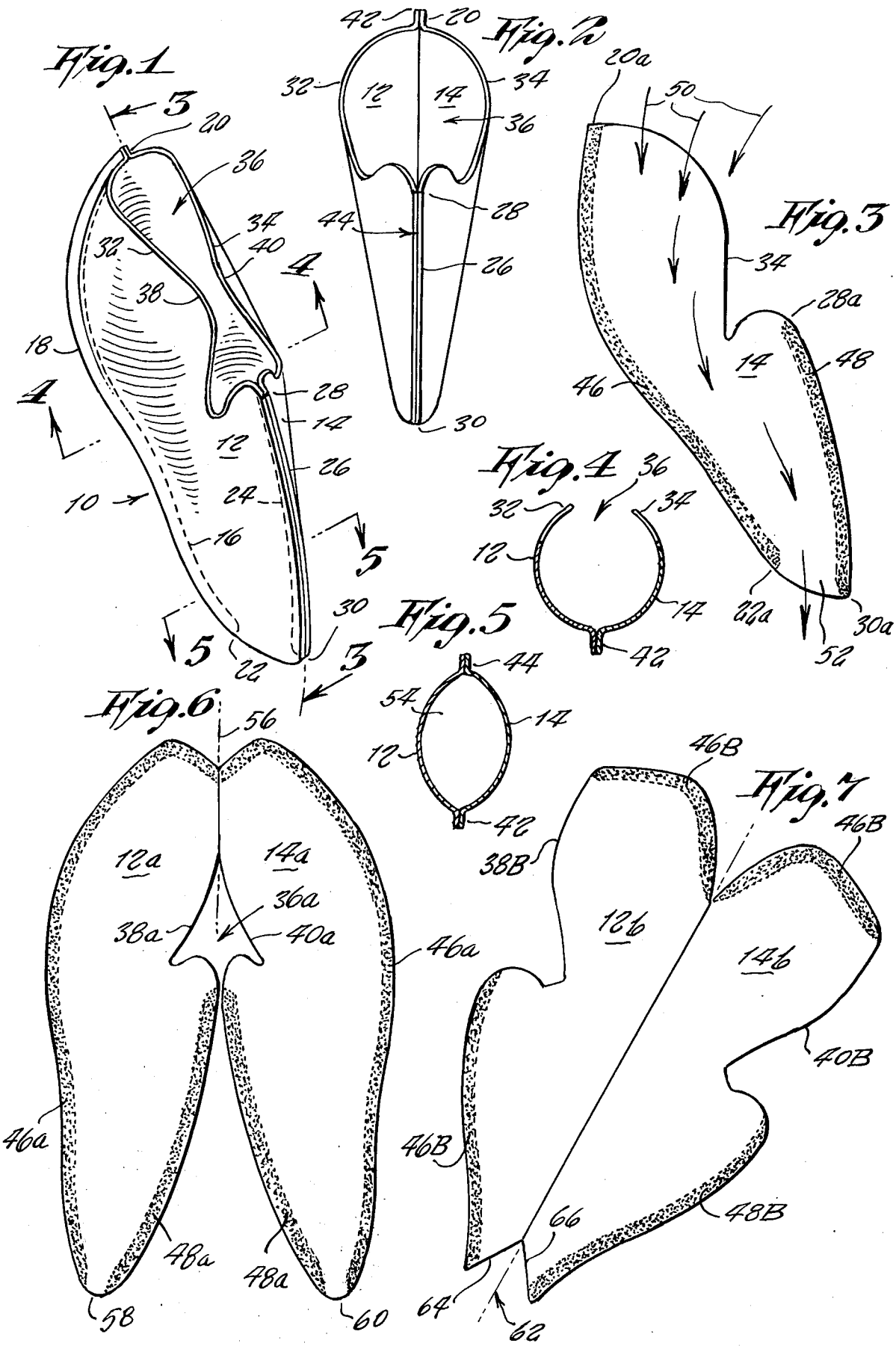
FIG. 1 is a perspective view of the present invention.
FIG. 2 is a plan view of the embodiment of the present invention depicted in FIG. 1 disposed in a flattened condition.
FIG. 3 is a side elevation view taken along line 3—3 viewed in the direction of arrows 3—3 as shown in FIG. 1.
FIG. 4 is a side elevation cross-sectional view taken along line 4—4 viewed in the direction of arrows 4—4 as shown in FIG. 1.
FIG. 5 is a side elevation cross-sectional view taken along line 5—5 viewed in the direction of arrows 5—5 as shown in FIG. 1.
FIG. 6 is a plan view of a first alternate embodiment of an unassembled funnel fabricated from one piece of material.
FIG. 7 is a plan view of a second alternate embodiment of an unassembled funnel fabricated from one piece of material.

The structure and method of fabrication of the present invention is applicable to a pair of similarly shaped sheets of flexible or pseudo-flexible material, fabricated from a liquid impervious fabric, such as plastic, impregnated paper, or impregnated non-woven materials. Two portions of the marginal edges of at least one of the sheets are coated with an adhesive material and forced into contact with the overlying juxtaposed sheet. Thus, a pair of flanges are formed joining the sheets together in areas adjacent two portions of the marginal edges of the sheets. There are two remaining unsecured portions of the marginal edges intermediate the two secured portions of the marginal edges. One of the unsecured portions of the marginal edges comprises a collecting mouth, whilst the other unsecured portion comprises a dispensing mouth. The collecting mouth is substantially larger than the dispensing mouth, which is disposed at one end of the apparatus having a generally elongated shape. The collecting mouth is substantially disposed along the side of the apparatus so as to have a portion of the length of one of the joined marginal edges adjacent and opposite thereto. The device is maintained in a flattened state prior to use. Opposed marginal joined edges, when disposed in close proximity to each other, causes each of the two sheets to bulge outwardly from one another, creating a three dimensional shape for the apparatus. Both mouth portions are forced into an opened state and the volume of included space between the marginal edges defining the collecting mouth and the marginal edges defining the dispensing mouth, thence becoming available for the storage of liquids accumulated rapidly through the collecting open mouth to be dispensed more slowly through the smaller dispensing mouth. Convolutions, formed in the marginal edges of the collecting mouth may, when forced manually inwardly in a three dimensional erected funnel, be utilized to maintain the three dimensional shape of the funnel, thereby enhancing its utility.

The alternate embodiments include all the characteristics described here-in-above as well as the apparatus being constructed from a single sheet of material utilizing a single fold line to form part of one of the joined together marginal edge portions, thereby further lowering the cost of manufacture due to an increase in the ease of assembly.

Now referring to the Figures and more particularly to the embodiment illustrated in FIG. 1 showing the preferred embodiment 10 of the present invention comprising sheet 12 and sheet 14 being joined together intermediate dotted lines 16 and solid line 18 confined between points 20 and 22, and joined together intermediate dotted lines 24 and solid line 26 between points 28 and 30. Marginal edges 32 and 34 are disassociated from one another and define a collecting mouth 36. In similar fashion, the marginal edges intermediate points 22 and 30 define a dispensing mouth, not shown, having a smaller sized opening than collecting mouth 36. Collecting mouth 36 is shown disposed substantially along the length of funnel 10 and intermediate points 20 and 30 defining such length. The collecting mouth 36 is also disposed opposite a portion of the seam defined by dotted lines 16, opposite thereto. The dispensing mouth is shown generally disposed on an opposite side to the location of the collecting mouth 36 and adjacent the other end of the length of the funnel. Convolutions 38 and 40, when manually forced into the opening of collecting mouth 36 tends to maintain the collecting mouth in an open position thus enhancing the three dimensional stability of the erected apparatus.

FIG. 2 shows collecting mouth 36 defined by marginal edges 32 and 34 and confined between point 20 of seam 42 and point 28 of seam 44. Seam 42 and seam 44 are disconnected from one another so as to define the dispensing mouth, not shown.

FIG. 3 illustrates sheet 14 having shaded areas 46 and 48 used to fabricate seams 42 and 44, as shown in FIG. 2. Marginal Edge 34 forms the open mouth portion 36, shown in FIGS. 1 and 2, so as to permit liquid to be dispensed in the directions of arrows 50 along the length of sheet 14. The open mouth 52 is formed intermediate points 22*a* and 30*a* at the ends of shaded areas 46 and 48 respectively.

FIG. 4 illustrates seam 42, as shown in FIG. 2, and sheets 12 and 14 adjacent thereto, additionally forming open mouth portion 36 intermediate marginal edges 32 and 34.

FIG. 5 illustrates seam 42, as shown in FIG. 2, and seam 44 as shown in FIG. 2, at the joined marginal edges of sheets 12 and 14, defining void 54 there-in-between used as a reservoir to store liquid, not shown, to be ultimately dispensed by dispensing mouth 52, as shown in FIG. 3.

FIG. 6 illustrates one piece of material fabricated from symetrical joined sub-sections 12*a* and 14*a* shown joined together along dotted lines 56. Shaded areas 46*a*, when placed in overlying relationship by folding about dotted lines 56, create a seam equivalent to seam 42 as shown in FIG. 2. In similar fashion, shaded areas 48*a*, when placed in overlying relationship by folding about dotted lines 56, create a seam equivalent to seam 44, as shown in FIG. 2. Marginal edges 38*a* and 40*a* define collecting mouth 36*a*, whilst points 58 and 60 are contained within a dispensing mouth.

FIG. 7 illustrates one piece of material fabricated from symetrical joined sub-sections 12*b* and 14*b* shown joined together along dotted lines 62. Shaded areas 46*b*, when placed in overlying relationship by folding about dotted lines 62, create a seam equivalent to seam 42 when added to the fold line along dotted lines 62. In similar fashion, shaded areas 48*b*, when placed in overlying relationship by folding about dotted lines 62, create a seam equivalent to seam 44, as shown in FIG. 2. Marginal edges 38*b* and 40*b* define a collecting mouth, similar to the collecting mouth 36, as shown in FIGS. 1 and 2 whilst points 64 and 66 are contained within a dispensing mouth.

One of the advantages of the present invention is a disposable funnel which can be economically fabricated from two sheets of material requiring minimally one motion on the part of the user to open the device from a flattened two dimensional storage position into a three dimensional use position.

Another advantage of the present invention is a funnel apparatus which may, if desired, be forced to retain a three dimensional shape when opened up from a flattened state.

Still another advantage of the present invention is a funnel which is totally pre-assembled prior to use and maintained in a flattened condition there-before.

Yet another advantage of the present invention is a disposable funnel that may be economically fabricated from two identically shaped sheets of material, thereby minimizing the cost of manufacture.

A further advantage of the present invention is a disposable funnel whose collecting mouth portion is disposed alongside the length thereof, thereby facilitating the use of such a device in adding liquids to the carburetor or gas tank of a motor vehicle.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an inclusive privilege or property is claimed are defined as follows:

I claim:

1. A disposable funnel comprising a pair of sheets, said sheets having a pair of outermost surfaces thereof disposed in overlying relationship to each other, said pair of outermost surfaces having congruent marginal edges, said marginal edges defining a pair of innermost surfaces, said innermost surfaces being disposed in touching engagement to each other, a first portion of one of said innermost surfaces fixedly secured to a first portion of the other of said innermost surfaces, said first portion of said one innermost surface and said first portion of said other innermost surface disposed adjacent a first portion of said marginal edges, a second portion of said one innermost surface fixedly secured to a second portion of said other innermost surface, said second portion of said one innermost surface and said second portion of said other innermost surface disposed adjacent a second portion of said marginal edges, a third portion of said marginal edges, a fourth portion of said marginal edges, one end of said first portion of marginal edges being disposed adjacent one end of said third portion of marginal edges, the other end of said third portion of marginal edges being disposed adjacent one end of said second portion of marginal edges, the other end of said first portion of marginal edges being disposed adjacent one end of said fourth portion of marginal edges, the other end of said fourth portion of marginal edges being disposed adjacent said other end of said second portion of marginal edges, said third portion of marginal edges defining a collecting mouth, said fourth portion of marginal edges defining a dispensing mouth, said marginal edges defining a substantially elongated shape, said dispensing mouth being disposed on one side of said elongated shape adjacent the other end thereof.

2. The disposable funnel as claimed in claim 1 wherein said pair of sheets comprises a waterproof material.

3. The disposable funnel as claimed in claim 1 further comprising excursions occupying a sub-portion of said third marginal edges, said excursions extending outwardly from the remaining portion of said third portion of marginal edges, said excursions being disposed into said collecting mouth maintaining said collecting mouth disposed in an open state.

4. The disposable funnel as claimed in claim 1 further comprising one of said pair of innermost surfaces and one of said pair of outermost surfaces being disposed on a unitary sheet, the other of said pair of innermost surfaces and the other of said pair of outermost surfaces being disposed on another unitary sheet.

5. The disposable funnel as claimed in claim 1 further comprising said pair of outermost surfaces being disposed contiguously to each other on one surface of a unitary sheet, said pair of innermost surfaces being disposed contiguously to each other on said unitary sheet, a fold line, said fold line being disposed intermediate said other end of said first portion of marginal edges and said one end of said fourth portion of marginal edges.

6. The disposable funnel as claimed in claim 1 further comprising said pair of outermost surfaces being disposed contiguously to each other on one surface of a unitary sheet, said pair of innermost surfaces being disposed contiguously to each other on said unitary sheet, a fold line, said fold line being disposed intermediate said one end of said first portion of marginal edges, and said one end of said third portion of marginal edges.

7. The disposable funnel as claimed in claim 5 wherein said marginal edges are disposed in mirror-image relationship about said fold line.

8. The disposable funnel as claimed in claim 1 wherein said third portion of marginal edges have a greater length than said fourth portion of marginal edges.

9. The disposable funnel as claimed in claim 1 wherein said dispensing mouth defines a smaller opening than said collecting mouth.

* * * * *